United States Patent [19]

Mori et al.

[11] 4,090,039

[45] May 16, 1978

[54] ELECTRODYNAMIC TRANSDUCER

[75] Inventors: Yoshihisa Mori, Tokyo; Kazuo Shimura, Hatogaya, both of Japan

[73] Assignee: Sony Corporation, Tokyo, Japan

[21] Appl. No.: 702,608

[22] Filed: Jul. 6, 1976

[51] Int. Cl.[2] ..... H04R 9/16

[52] U.S. Cl. ..... 179/100.41 D; 179/100.41 K; 274/37

[58] Field of Search ..... 179/100.41 D, 100.41 M, 179/100.41 Z, 100.41 K; 360/124; 274/37

[56] References Cited

U.S. PATENT DOCUMENTS

| | | | |
|---|---|---|---|
| B 526,388 | 2/1976 | Mori | 179/100.41 M |
| 2,027,168 | 1/1936 | Harrison | 179/100.41 D |
| 2,962,561 | 11/1960 | Redlich | 179/100.41 K |
| 3,014,992 | 12/1961 | Redlich | 179/100.41 K |
| 3,679,843 | 7/1972 | Cho | 179/100.41 K |
| 3,729,596 | 4/1973 | Toth | 179/100.41 K |
| 3,766,330 | 10/1973 | Hepp | 179/100.41 K |
| 3,956,598 | 5/1976 | Kawakami | 179/100.41 D |

FOREIGN PATENT DOCUMENTS

| | | | |
|---|---|---|---|
| 1,000,035 | 8/1965 | United Kingdom | 179/100.41 K |

*Primary Examiner*—Bernard Konick
*Assistant Examiner*—Alan Faber
*Attorney, Agent, or Firm*—Lewis H. Eslinger; Alvin Sinderbrand

[57] ABSTRACT

An electrodynamic transducer comprising a source of magnetic flux and poles that define an annular gap in the flux path to obtain a radially oriented and uniformly distributed magnetic flux across the gap. Coils are mounted on a support that pivots universally about a center concentric with the gap. The coils are placed on the support so that pivotal movement of the latter causes a change in flux linkage with the coils. The coils are wound in such a manner that the electric potentials generated in diametrically opposite coils are added together. There may be sets of mutually perpendicular coils.

3 Claims, 12 Drawing Figures

ELECTRODYNAMIC TRANSDUCER

BACKGROUND OF THE INVENTION

1. Field of the Invention

The present invention relates to an electrodynamic transducer, and more particularly to an electrodynamic transducer for playback from phonograph records.

2. Description of the Prior Art

In a known electrodynamic sound pick-up, two coils perpendicular to each other in a magnetic field are supported by a cantilever arm held fixed at one end to cause the center of oscillation to be located at that end. The coils are spaced a certain distance from the fixed end and are connected to the cantilever arm by an insulating supporting member. Such a structure allows a relatively large amplitude of movement for the coils so that a relatively large amount of magnetic flux can be intersected by the coil windings. As a result, a high signal voltage, or a high transducer output voltage, is obtained. However, the inertial moment of oscillation of such a structure is high because the path of movement of the coils requires a large radius.

There are existing electrodynamic transducers of another type in which two triangularly shaped coils are arranged on both sides of and parallel to a cantilever arm capable of oscillating in any direction. The structure requires a wide, and thus disadvantageous, air gap, since the effective coil sections located in the gap are arranged one behind the other.

OBJECTS AND SUMMARY OF THE INVENTION

An object of the present invention is to provide a novel electrodynamic transducer free from the drawbacks in the prior transducers.

Another object of the present invention is to provide an electrodynamic transducer allowing easy winding of coils substantially in a FIG. 8 shape on a supporting member, thereby simplifying manufacture of the coils.

Other objects and advantages of the present invention will become apparent from the following description.

The present invention is an electrodynamic transducer that has means to produce a substantially constant flux and poles with an annular air gap between them. The poles guide the flux so that it extends substantially uniformly across the air gap in a generally radial direction. One of the poles may include a round opening and the other pole may include a round post concentric with the opening and extending into or close to the opening. The flux source, which preferrably comprises permanent magnetic means, causes flux to span the annular air gap between the end of the post and the perimeter of the circular opening.

A supporting member with a cantilever arm is attached to the post by an elastic member, which may be referred to as a damper, and a tension wire. A stylus shaped to engage phonograph record grooves is mounted at the free end of the cantilever arm, and coils wound in a configuration that is similar to a FIG. 8 are mounted on the supporting member in the air gap. Movement of the stylus by the phonograph groove causes the cantilever arm to pivot and thus to change the linkage of the air gap flux and the coils. The coils include two effective coil portions that are substantially perpendicular to the magnetic flux, ineffective coil portions that connect the effective coil portions, and members that prevent the ineffective coil portions from intersecting the the magnetic flux, thereby minimizing cross talk.

The coils include a first coil group located in a first area in the radial magnetic field, a second coil group located in a second area in the same field but displaced 180° from the first area, a third coil group located in a third area displaced 90° from the first area, and a fourth coil group located in a fourth area displaced by 180° from the third area. The first and second coil groups and the third and fourth coil groups, respectively, are wound substantially in a FIG. 8 shape to obtain increased output voltages. The center of oscillation of the supporting member is close to the coils, so that stereo output voltages can be obtained with little cross talk.

DESCRIPTION OF THE PREFERRED EMBODIMENTS

The electrodynamic transducer of the present invention will be described first with respect to the embodiment in FIG. 1–4. The magnetic circuit of the electrodynamic transducer includes a permanent magnet 10 with north and south poles at its opposite ends. A plate-shaped first pole piece **12*a* is attached to one end, and a yoke 12*b* is attached to the other end. The yoke 12*b* is provided with a rod-shaped second pole piece 12*c*, one end of which is located in a circular opening 13 in the first pole piece 12*a*, thereby defining an annular air gap 13*a* between the first and seond pole pieces 12*a* and 12*c*. All of the members 12*a*–12*c*** have low magnetic reluctance.

Figure 1:
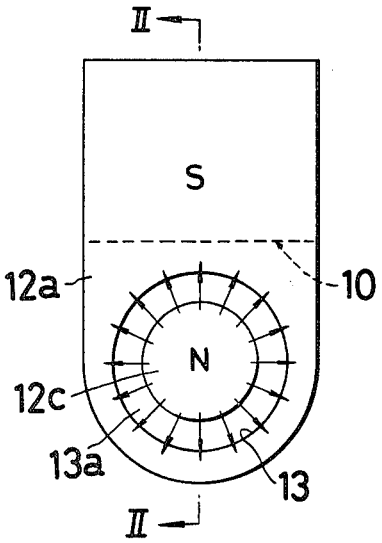
FIG. 1 is an elevational view of a magnetic ciruit assembly for use in an electrodynamic transducer according to the present invention.
Figure 2:
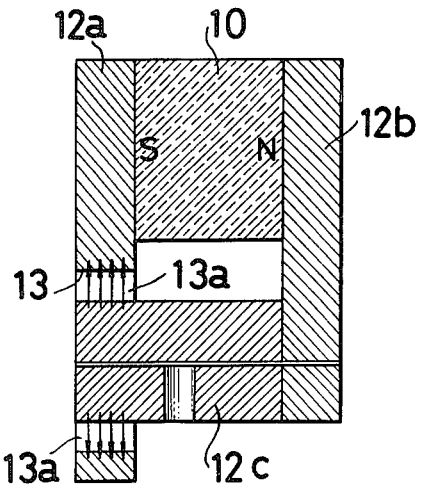
FIG. 2 is a cross sectional view of the assembly in FIG. 1 along the line II—II.
Figure 3:
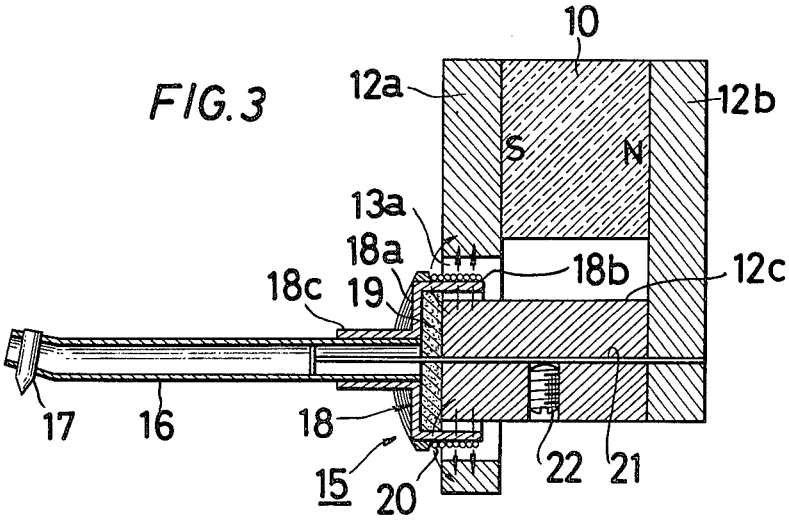
FIG. 3 is a simplified cross sectional lateral view of an electrodynamic transducer according to the present invention.

As shown in FIG. 3, in front of the end face of the second pole piece **12*c* there is a vibrating member 15 which includes a hollow cantilever arm 16 with a stylus 17 at the free end of the arm. The stylus has a point of the proper shape to engage a phonograph groove. A cylindrical coil supporting member 18 of an insulating material is attached to the arm 16, and a resilent damper 19 is located between the pole 12***c* and the supporting member 18. Coils 20 are provided on the supporting member 18. The cantilever arm 16 extends from the supporting member in the axial direction of the air gap 13*a*, and a tension wire 21 is attached within the arm 16 in a manner already known so that the wire passes through the second pole piece 12*c* and is mounted on the yoke 12*b*. The tension in the wire 21 is held fixed by a screw 22 in the second pole piece 12*c*.

Figure 4:
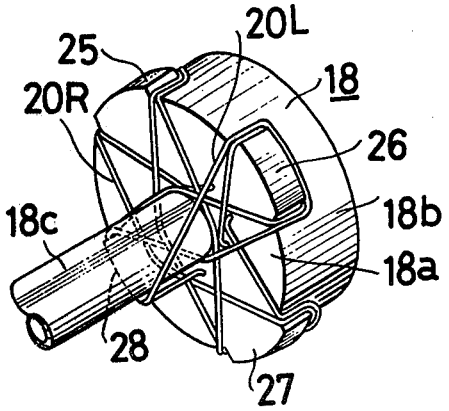
FIG. 4 is a magnified perspective view of part of the vibrating member shown in FIG. 3.

The supporting member 18 has a main part with a first face 18*a* perpendicular to the cantilever arm 16 and a second face 18*b* coaxial with the air gap 13*a*. The supporting member also includes a short tube 18*c* projecting from the first face 18*a* in which the cantilever arm is mounted. The tube 18*c* has a smaller diameter then the larger diameter main part where the first face 18*a* is located. As shown in FIG. 4, the second face 18*b* has, at one end, four projections 25, 26, 27 and 28 mutually spaced 90° apart. The coils are wound in a FIG. 8 shape on respective pairs of the projections 25–27 and 26–28 located symmetrically with respect to the axis of the cantilever arm 16. More specifically, a coil 20R for producing the right-channel signal of a complete stereophonic signal is wound in a FIG. 8 shape around the projections 25 and 27, while a similar coil 20L for producing the left-channel signal is wound in a FIG. 8 shape around the projections 26 and 28. The coils 20R and 20L are displaced from each other by 90° and are symmetrically arranged with respect to the axis of the cantilever arm 16.

The coils 20 include effective coil portions which are wound around the projections 25–28 and which generate electric potentials due to the changing flux linkages caused by the movement of the cantilever arm 16 as the stylus 17 follows the record groove. The coils 20 also include ineffective conductor portions generally parallel to the first face 18*a* of the supporting member 18. Although the ineffective portions do not intercept a changing flux value and therefore do not have voltages generated in them, they do perform the important function of electrically connecting effective coil portions.

The supporting member 18 on which coils 20 are mounted is attached, together with the cantilever arm 16, to th pole 12*c* by means of the damper 19 and the tension wire 21. In this manner the vibrating member 15 is attached to the pole piece 12*c* so that the coils 20 on the supporting member 18 are located in the air gap 13*a*, as shown in FIG. 3. The damper 19 is composed of a disc-shaped elastic material, usually rubber.

Figure 8:
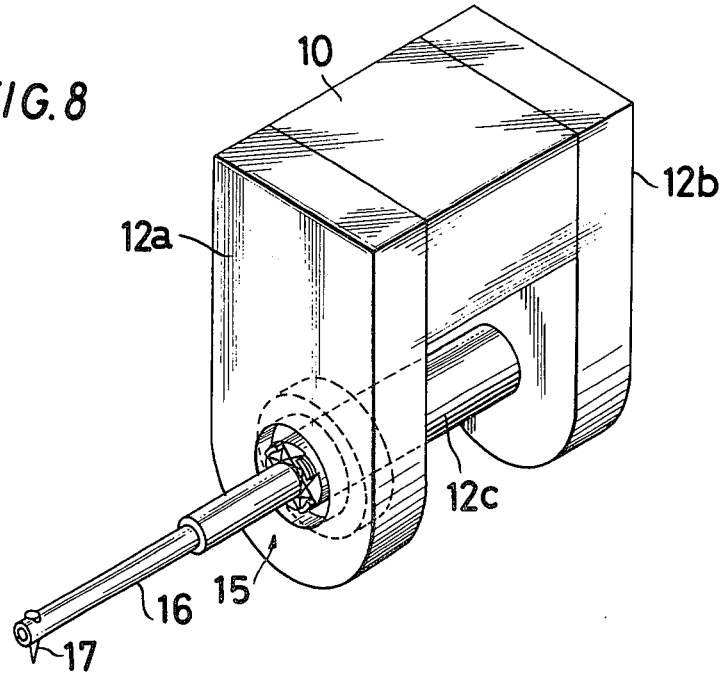
FIG. 8 is a perspective view of the electrodynamic transducer shown in FIG. 7.

Each of the FIG. 8 shaped coils 20L and 20R differentially intersects the magnetic flux in proportion to the movement of the stylus 17 and generates an output voltage as the electromotive forces in the two coil portions are added in series. The two coils 20L and 20R are mounted in 45°–45° directions with respect to the vertical plane. As a result, when the stylus 17 is driven by a left-channel groove modulation, a voltage is induced in the left-channel coil 20L but not in the right-channel coil 20R, which would merely be rotated around the central axis thereof without changing its flux linkage. The converse is true when the stylus 17 responds to a right-channel groove modulation. For this reason the electrodynamic transducer of the present invention can be employed as a cartridge for stereo playback.

In this manner the center of oscillation of the oscillating system becomes clearly defined, as the vibrating member 15 is affixed to the magnetic pole 12*c* the damper 19 and the tension wire 21. This results in a clearly defined mutual positional relationship between the center of oscillation and the coils and between the coils and the air gap. Stated differently, these facts allow exact positioning of coils in the air gap and result in uniformity of operation of production transducers of the same design. Furthermore it is to be noted that the coil portions around the projections 25 and 27, for example, generate currents that flow in mutually opposite directions, but which nevertheless are in phase because of the FIG. 8 shape of the coils, thereby making it possible to obtain an increased output signal without distortion at the coil terminals.

Figure 5:
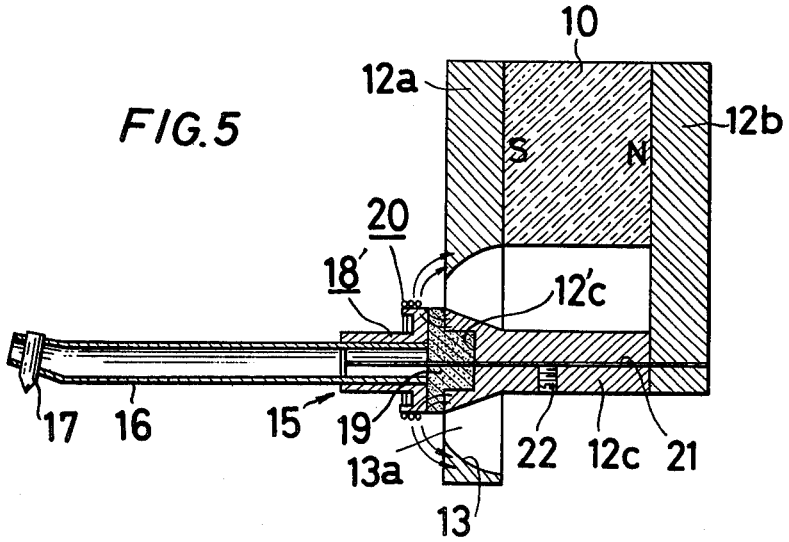
FIG. 5 is a simplified cross sectional lateral view of a second embodiment of an electrodynamic transducer according to the present invention.
Figure 6:
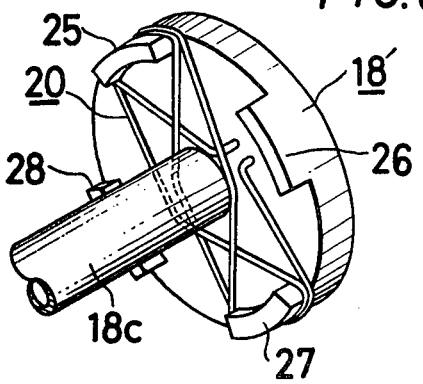
FIG. 6 is a magnified perspective view of the vibrating member shown in FIG. 5.

Referring to another embodiment of the transducer of which cross section is shown in FIG. 5, the opening 13 through the pole piece 12*a* is tapered, and the pole piece 12*c* is also tapered with an increased diameter at the end adjacent the pole piece 12*a*. The pole piece 12*c* has a recessed end 12*c*′ in which the damper 19 is fitted. The supporting member 18′ constituting a part of the vibrating member 15 has four projections 25, 26, 27 and 28 spaced 90° apart and extending away from the pole piece 12*c*, as shown in FIG. 6. Only a single coil is shown wound in a FIG. 8 shape around the projections 25 and 27. The other coil that would be wound in a similar manner around the projections 26 and 28 is omitted in the drawing for simplicity. The winding of coils is facilitated by the use of the supporting member 18′. The tapered structure of the air gap 13*a* resulting from the tapered shape of the pole pieces 12*a* and 12*c* in FIG. 5 causes the magnetic flux from the magnet 10 to concentrate more densely through the coils 20, thus resulting in an even larger output signal due to a greater change of flux linkage for a given deflection of the member 18′ in the structure of FIG. 5 than of the member 18 in the structure of FIG. 3.

Figure 7:
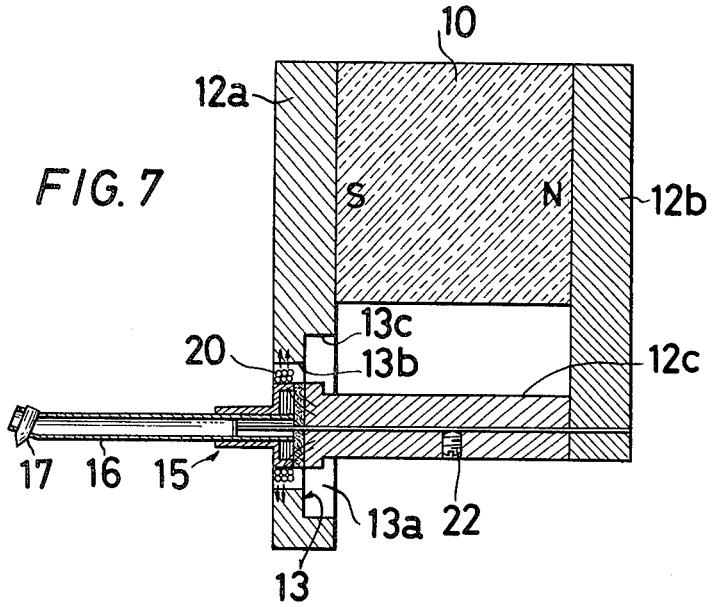
FIG. 7 is a simplified cross sectional lateral view of a third embodiment of an electrodynamic transducer according to the present invention.

FIGS. 7 and 8 illustrate another structure for increasing the amount of magnetic flux intersecting the coils. In this embodiment the opening 13 in the pole piece 12*a* has a smaller diameter portion 13*b* at the front side (the side nearer the stylus 17)and a larger diameter portion 13*c* at the rear side. The coils 20 are located in the smaller diameter portion 13*b* while the front end of the pole piece 12*c* extends only into the larger diameter portion 13*c*. The magnetic flux in this structure tends to emerge mostly through the end of the pole piece 12*c* and thus to be concentrated to pass through the coils 20.

In the foregoing embodiments, for example the embodiment shown in FIGS. 3 and 4, the coils 20R and 20L cross each other in the central portion of the supporting member 18, i.e. in the vicinity of the smaller diameter tube 18*c*. As a result, there is a pile-up of wires around the tube portion 18*c*, as shown in FIG. 3, thus rendering it difficult to wind the coils on the supporting member 18 properly. Such structure requires excessive length of conductors in the ineffective portions, which are those conductor portions that do not contribute to the generation of output voltage. This not only leads to a wasted use of conductor material but also results in a relatively large mass of the vibrating member, or armature, which, in turn, limits the sensitivity of the transducer.

Figure 9:
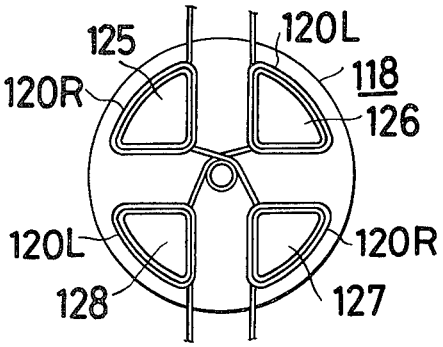
FIG. 9 is a rear elevational view of the vibrating assembly of a fourth embodiment of an electrodynamic transducer according to the present invention.
Figure 10:
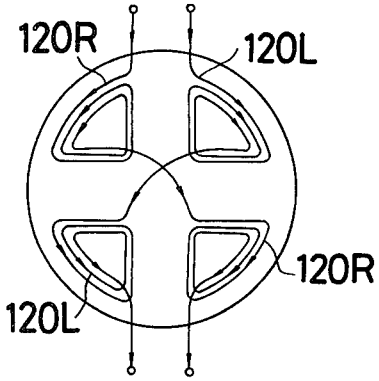
FIG. 10 is a schematic wiring diagram of the coils shown in FIG. 9.

The above-mentioned drawbacks are minimized in the example of coil windings shown in FIG. 9, in which the supporting member 118 is provided with four approximately triangular projections 125, 126, 127 and 128. To form the coil 120R for the right-hand channel, several turns are wound around the projection 125. The conductor then passes across the central area of the supporting member 118 and is wound around the projection 127. Similarly the coil 120L for the left-hand channel is formed by winding several turns around the projection 126, then passing the conductor across the central area of the supporting member 118 and winding several turns around the projection 128, as schematically indicated in FIG. 10. As will be evident from FIGS. 9 and 10, this structure has only two wires, in the minimum case, crossing in the center of the supporting member 118 so that there is no pile-up of undesired conductors. The winding operation is made relatively simple as the coils 120R and 120L can be prepared by winding conductors directly around each of the projections 125–128. It is also possible to wind the wires around suitable bobbins and to fit such prefabricated coils onto the projections.

Figure 11:
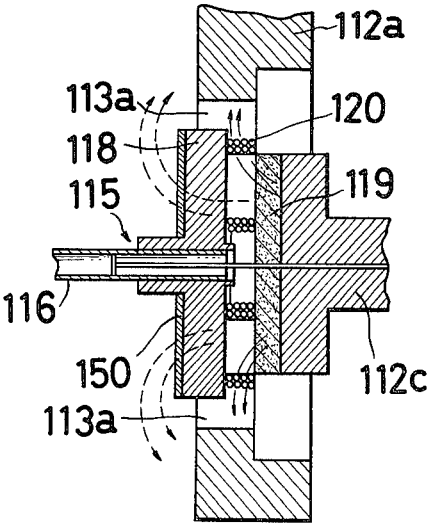
FIG. 11 is a cross sectional view of a principal part of the fourth embodiment of the present invention containing the vibrating assembly shown in FIG. 9.
Figure 12:
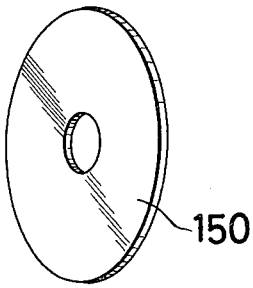
FIG. 12 is a perspective view of the copper ring shown in FIG. 11.

FIG. 11 is a cross sectional view of the principal signal generating part provided with the coils prepared as shown in FIG. 9, in which case the coils 120 are located on the opposite side of the member 118 from the cantilever arm 116. The supporting member 118 is affixed to the pole piece **112*c* by means of the damper 119, while the pole piece 112*c* is separated from the pole piece 112*a* by the air gap 113*a*. The pole pieces 112*a* and 112*c* are similar to the pole pieces 12*a* and 12*c* in FIG. 7. FIG. 11 also includes a member 150 at the end face of the supporting member 118 for preventing the passage of magnetic leakage flux through the coils in a direction that does not lead to changing flux linkages and thus generating signals when the vibrating member 115 pivots back and forth. The member 150 may be, for example, a copper ring as shown in FIG. 12. As the signal generation correctly corresponding to the record groove is achieved only by the coil portions perpendicularly intersecting the magnetic flux from the pole piece 112*c*, it is desirable that no other coil portions contribute to the signal generation. Contribution from the ineffective coil portions will result in cross talk between two channels. For this reason, by providing a suitable member 150 such as a copper ring in a position corresponding to the ineffective coil portions, the magnetic leakage flux (as represented by broken lines in FIG. 11) is substantially balanced out by flux from the member whereby the contribution of such ineffective coil portions to the signal generation is practically dissipated, and the cross talk is prevented. Also the magnetic field generated by the current formed in the member 150 exerts an electromagnetic braking force which exerts a desirable damping effect on the vibrating member 115**.

The use of such member 150 is not necessarily limited to the vibrating member 115 shown in FIG. 11 but is naturally suitable also for the vibrating members shown in FIGS. 3, 5 and 7. Also it will be understood that it is not limited to a copper ring but can also be prepared by copper plating or any other electroconductive materials.

What we claim is:

1. An electrodynamic transducer for stereo signals comprising:

magnetic means for generating a dense and substantially constant magnetic flux, said magnetic means including a permanent magnet having opposed poles at opposite ends thereof, first and second plate-shaped members extending substantially parallel to each other from said opposite ends of the magnet, said first member having a circular hole therein and constituting a first pole-piece, and a generally rod-shaped second pole-piece extending from said second member coaxially in respect to said hole and having a circular end face of smaller diameter than said hole facing axially toward the latter from outside said hole to define an annular gap across which the magnetic flux travels between the axially directed end face of said second pole-piece and the radially directed margin of said hole in the first pole-piece;

a vibrating member including a supporting disc fitting in said hole, a cantilever arm extending axially from the center of said supporting disc, and a stylus at the free end of said arm;

connecting means for connecting said vibrating member to said second pole-piece including an elastic damper member interposed between said supporting disc and said end face of the second pole-piece so that said vibrating member is pivotally movable about a center of oscillation in the region of said damper member;

said supporting disc having symmetrically arranged first and second pairs of diametrically opposed projections extending from a face of said disc at right angles to each other and having radially outer and inner edge portions disposed so that said magnetic flux predominantly passes through said outer edge portions; and first and second coils including respective turns wrapped around said first and second pairs, respectively, of the projections on said supporting disc with said turns of each of said coils being wound in opposite directions about the respective pair of projections and being connected in series, and with the portions of said turns of the coils on said radially outer edge portions of the respective projections being primarily effective for linkage with said flux between said first and second pole pieces.

2. An electrodynamic transducer for stereo signals according to claim 1; in which said first pole-piece has an annular, radially enlarged recess extending around said hole at the side of the latter facing toward said second pole-piece, and said second pole-piece extends axially into said recess.

3. An electrodynamic transducer for stereo signals according to claim 2; in which said second pole-piece has a radially enlarged end portion within said recess.

* * * * *